United States Patent [19]

Holston et al.

[11] Patent Number: 4,918,903

[45] Date of Patent: Apr. 24, 1990

[54] PROCESS FOR BOTTLING LIQUID PRODUCTS WHICH WILL CONTAIN FRAGRANCE OILS

[75] Inventors: Sylvester Holston; Robert Ziek, both of Cincinnati; William Woodruff, Urbana, all of Ohio

[73] Assignee: The Drackett Company, Cincinnati, Ohio

[21] Appl. No.: 360,652

[22] Filed: Jun. 2, 1989

[51] Int. Cl.[5] ..... B65B 3/04; B67B 3/20

[52] U.S. Cl. ..... 53/471; 53/400; 53/474; 53/490

[58] Field of Search ..... 53/467, 471, 474, 490, 53/400, 402

[56] References Cited

U.S. PATENT DOCUMENTS

| | | | |
|---|---|---|---|
| 2,907,173 | 10/1959 | Robbins | 53/474 X |
| 3,117,699 | 1/1964 | Epstein | 53/474 X |
| 3,233,791 | 2/1966 | De Wayne Miles | 53/474 X |
| 3,415,702 | 12/1968 | Bauder | 53/400 X |
| 3,805,475 | 4/1974 | Glenn | 53/474 X |
| 4,094,119 | 6/1978 | Sullivan | 53/400 |
| 4,254,603 | 3/1981 | Obrist | 53/490 |
| 4,330,425 | 5/1982 | Boden et al. | 252/187 H |
| 4,337,163 | 6/1982 | Schilp | 252/96 |
| 4,379,071 | 4/1983 | Schnöring et al. | 252/316 |
| 4,395,344 | 7/1983 | Maddox | 252/99 |
| 4,440,542 | 3/1984 | Foley | 8/523 |
| 4,552,680 | 11/1985 | Hartman et al. | 252/102 |
| 4,561,997 | 12/1985 | Roehl | 252/522 A |
| 4,576,737 | 3/1986 | Johnson | 252/522 A |
| 4,587,129 | 5/1986 | Kliment | 426/534 |
| 4,623,476 | 11/1986 | Nayar et al. | 252/94 |
| 4,668,434 | 5/1987 | Bowman | 252/522 A |
| 4,680,916 | 7/1987 | Ginn | 53/474 X |

*Primary Examiner*—Horace M. Culver

*Attorney, Agent, or Firm*—Charles J. Zeller

[57] ABSTRACT

A process for packaging, especially bottling, a liquid product which will contain a fragrance oil or other material capable of adversely affecting a capping or other package closure operation if said oil or material came in contact with a mating sealing edge thereof, the process comprising sequentially filling the liquid product and fragrance oil or other material into a package, the fragrance oil or other material being added to said package in temporarily bound form.

16 Claims, No Drawings

PROCESS FOR BOTTLING LIQUID PRODUCTS WHICH WILL CONTAIN FRAGRANCE OILS

FIELD OF INVENTION

This invention relates to a process for packaging liquid compositions containing material that adversely interferes with the closure system of said package. More particularly, it concerns a process of this character for bottling liquid compositions destined to have said adversely interfering material, typically a material having an oily or lubricating character, incorporated therein. Most specifically, the present invention concerns liquid compositions wherein said material is a fragrance oil.

BACKGROUND OF INVENTION

It is customary to incorporate, e.g., fragrance oils, in many liquid products, including products intended for use as household cleaning, disinfecting, sanitizing, bleaching, deodorizing or drain opening products. One method used to accomplish this end is to disperse the material having said lubricating tendency (hereinafter illustratively referred to as fragrance oils) in the liquid product, typically a primarily aqueous product, with the aid of a surface active agent, after which the product is filled into bottles that are then capped. However, such a procedure has several disadvantages. First, the dispersion step entails the use of expensive surfactants that add to the cost of the product. Moreover, this dispersion process attenuates the desired characteristics of the fragrance oil, thereby requiring the use of additional fragrance oils to achieve like results.

Efforts to reduce the costs of these products by adding the fragrance oils and the bulk of the liquid product to the bottle separately introduced new problems in the bottling operation. Thus, the fragrance oils often splashed onto the threads of the bottle neck and served as an unwanted lubricant between the threads on the neck of the bottle and the threads of the cap, during the capping operation.

The capping step is generally an automatic operation which employs a torque sensing device to signal the end of the operation in which the cap is screwed on to the bottle. As the cap is being screwed onto the top of the bottle by the capper, the torque being applied to the cap increases. When a preset torque level is reached the torque sensor signals the capper to cease applying a torque to the cap. Where fragrance oils are present on the bottle neck threads there is less friction between the bottle neck threads and screw cap threads during the capping operation. As a consequence, the cap is screwed further into the bottle neck threads before the torque being applied by the capper reaches its preset limit that signals the termination of the screwing process. The end result is a higher immediate release torque on the capped bottle, that is to say that a greater force is required to unscrew the cap from the bottle than is the case when there are no fragrance oils on the bottle neck threads. Because only a small and indefinite number of bottle necks become wetted with the fragrance oils it is not possible to make allowance for the effect noted and it is inherently impossible to obtain uniform release torques.

A better idea of the problem may perhaps be gleaned by a comparison of the Immediate Release Torque data obtained from capped bottles that were bottled in accordance with "normal" bottling operation (i.e. where no fragrance oil was added to the bottle before capping) and that obtained from capped bottles bottled by a process which also includes the separate or discrete addition of fragrance oils in liquid form to the bottle. This data is summarized in the table below:

| Immediate Release Torque (in.-lbs.) | |
|---|---|
| "Normal" Operation | Fragrance Oil Added in Liquid Form |
| X = 20 in.-lb. | X = 30 in.-lb. |
| S = 1.7 | S = 5.0 |
| ± 3S = 15–25 in.-lb. | ± 3S = 15–45 in.-lb. |

where X = Average torque necessary to unscrew capped bottled.
S = Standard deviation of sample.
± 3S = Range of 99.7% of the data points.

As this data indicates the standard derivation, i.e. the degree to which the individual torque measurements differ from each other, is 2.94 times greater when the fragrance oils are added in liquid form during the bottling operation compared to the case in which fragrance oils are not added. This is a clear indication of the difficulty in obtaining a uniform release torque rate with the former bottling operation.

THE INVENTION

It has now been found that the above-described problem can be satisfactorily solved if the fragrance oils are employed in a temporarily bound form during the bottling operation. That is to say that the fragrance oils are utilized in a form in which they are not capable of wetting the threads of the bottle neck to an extent sufficient to serve as a lubricant between the threads of the bottle neck and the threads of the cap. It should be understood that reference above and elsewhere in this application to "fragrance oils" is intended to be illustrative only of the present invention encompassing a process for adding any material that interferes with a packaging operation. Furthermore, as used herein the phrase "packaging operation" includes, but is not limited to, closure procedures involving bottling or other torquing procedure, heat sealing, adhesive or other pressure-sensitive sealing, sonic sealing, and friction fitting.

PRIOR ART

Spanish Patent No. 554,709 filed Apr. 24, 1986 and granted May 6, 1987 to Henkel teaches a process for making a perfumed aqueous hypochlorite composition. In this process perfume is pressure-injected into the bottle containing a hypochlorite solution. There is no teaching in this patent of adding the fragrance oils in bound form as is characteristic of the present invention.

Foley, U.S. Pat. No. 4,440,542, relates to an article for controllably releasing water immiscible components into an aqueous system. The article is essentially a silica-silicate foam on which is adsorbed a water-immiscible component. Fragrance oils are exemplified as water immiscible components. However, no bottling procedure is disclosed by Foley.

Schilp, U.S. Pat. No. 4,337,163, discloses a liquid, pourable thickened chlorine bleach composition which contains a silica acid salt as a buffer. A perfume is an optional ingredient for Schilp. No bottling procedure is disclosed.

Kliment, U.S. Pat. No. 4,587,129, discloses novel gels having flavors or fragrances trapped therein. No bottling process is disclosed in this patent.

U.S. Pat. No. 4,330,425 to Boden, et al. discloses hypochlorite bleach compositions containing a perfume composition. At column 17, lines 23, et seq., Boden, et al. indicates that the perfume may be contained in a vehicle or carrier, including absorbent solid carriers such as a gum or a gelatin-encapsulating material. Liquid vehicles such as ethanol and propylene glycol are also disclosed. The crux of the Boden invention is to obtain a long-lasting perfume aroma capable of imparting to surfaces a woody, etc., aroma. Boden does not clearly indicate why the perfume would be contained in such a vehicle, nor does Boden suggest addition of that perfume-containing vehicle as the last filling step in a bottling process.

In U.S. Pat. No. 4,561,997 to Roehl (Naarden), a process for the preparation of aqueous air freshener gels is disclosed wherein a perfume is mixed with an inorganic carrier such as a silica absorption agent, the admixture then being added to an aqueous gel or the gel-forming components. The '997 patent is easily distinguished in that it concerns a solid composition, which would not be subject to the problems encountered when the perfume is added to the container as a liquid.

DETAILED DESCRIPTION OF INVENTION

As used herein the term "temporarily bound form" refers to any of a variety of means for maintaining the fragrance oils (or other material that interferes in the packaging operation) in a form so that it may be introduced into a bottle (or other package) without wetting the threads (or sealing edge) of the bottle with the material. At the same time, this term implies that the bound form is such that the fragrance oils are capable of being released into the liquid product that will also be contained in the bottle within a reasonable period of time which generally will be less than about 24 hours and typically will be in the range of from about 10 seconds to about six hours, preferably between 15 minutes and two hours. However, the length of time to release the material depends on when the product itself is to be used. In most instances where product is to be inventoried and then shipped to retail outlets, time for release is not critical.

A variety of means is available by which fragrance oils may be maintained in temporarily bound form in accordance with the purposes of the present invention. One such means involves forming a gel that contains the fragrance oils. In a typical case, the gel structure is formed by merely mixing the fragrance oils, which are liquid in form, with a gelling agent. The oil is present in such amount that it serves as a suspending medium for the gelling agents. Generally the gel structure will be formed by mixing from about 10% to about 90% by weight of gelling agent with about 10% to about 90% by weight of fragrance oil, these percentages being percent by weight based on the total weight of the finished mixture.

A variety of gelling agents are known in the prior art that are useful for this purpose. These include materials as fumed silicas and synthetic silicas (e.g. Hi-Sil T600); cellulose thickeners especially carboxymethylcellulose and hydroxyethyl-cellulose; synthetic clays such as sodium magnesium silicate and magnesium aluminum silicate; modified clays such as hectorites; aluminum silicate hydrate (montmorillonite); acrylic polymers, e.g., Colloid 204, and gums such as xanthan. One type of gelling agent that has been found to be particularly suitable for the present invention is the fumed silicas and especially the product marketed under the trade designation Cab-O-Sil Grade M-5.

It is sometimes advantageous to increase the gel density of the gelled fragrance oil product. Several materials are known in the prior art that may serve this purpose. These include ionizable metal salts, especially ammonium, alkali metal and alkaline earth metal salts such as chlorides, sulfates and carbonates. These density increasing agents may be employed at various concentrations depending on the results desired, and generally constitute from about 1% to about 40% by weight of the gelled fragrance oil produced and preferably from about 10% to about 25% by weight on the same weight basis.

Another means for temporarily maintaining the fragrance oils in temporarily bound form, according to the present invention, is to have these oils contained in a gelatin capsule. A variety of means, which do not form part of this invention, are known in the prior art for incorporating the fragrance oils in the gelatin capsules. One of the preferred procedures involves the simultaneous forming, filing and sealing the gelatin capsule so as to form a unitary capsule containing the requisite amount of fragrance oils. These capsules are then used in the bottling procedure described in more detail below.

The quantity of fragrance oil that will be contained within the gelatin capsule may vary. Ordinarily the quantity of liquid product that will be bottled in each bottle filed by the present bottling procedure will determine the quantity of fragrance oil contained in each gelatin capsule. Typically each such capsule will contain about 0.01% to about 1% by weight of fragrance oil based on the total weight of the finished product and preferably from about 0.05% to about 0.5% by weight on the same weight basis. On a weight basis, a capsule typically contains from about 0.1 to about 5 gm of fragrance material, preferably from about 0.1 to about 1.0 gm.

As indicated above, it is a feature of the process of the present invention to bottle a liquid composition in combination with fragrance oils in which the latter is employed in a temporarily bound form. The liquid compositions to which this process may be employed are quite varied. The only limitation on the nature of the liquid product utilized is perhaps one in which it would be inappropriate to add a fragrance or in which the fragrance might interfere with the intended function of the product. The liquid compositions that are most suitable for use in this invention are household type liquid products and usually those that have a sizeable aqueous component. These would include cleaning compositions, disinfecting compositions, sanitizing composition, deodorizing compositions, bleaching compositions, drain openers and drain cleaners. However, it is particularly useful in connection with hypochlorite compositions and particularly with aqueous hypochlorite compositions.

Typical liquid hypochlorite compositions which may be used to practice the present invention are those which comprise water as the major or predominant component. In the usual case, the water will constitute from about 90% to about 99% by weight of the total liquid hypochlorite composition. In the preferred cases this will amount to from about 94% to about 98% by weight on the same weight basis.

Any of a variety of hypochlorites may be contained in this hypochlorite composition. However, most often the hypochlorite will take the form of an alkali metal hypochlorite and especially sodium hypochlorite. The quantity of hypochlorite present in the liquid hypochlorite composition useful in practicing the present process may vary depending on the intended use of the composition or the particular results desired from this composition.

Generally, the hypochlorite will constitute from about 1% to about 10% by weight based on the total weight of the liquid hypochlorite composition and preferably from about 2% to about 6% by weight on the same weight basis.

In addition to the hypochlorite, the liquid hypochlorite compositions used in the practice of this invention may include any of a variety of adjuvants commonly added to compositions of this character. Typical among such adjuvants there may be mentioned alkalizing agents, corrosion inhibitors, surfactants and alcohols. These will usually constitute a small fraction of the total weight of the liquid hypochlorite compositions.

In its broader sense the present process comprises (a) filling a liquid product into a bottle provided with a threaded neck, (b) adding to said bottle, before or after filling it with said liquid product, fragrance oils in temporarily bound form, (c) applying a threaded cap to said bottle containing said liquid product including said fragrance oils so that the threads of said cap engage the threads of said bottle, (d) applying a torque to said cap to tighten it to a predetermined degree on said bottle; and (e) allowing said fragrance oils contained in said bottle in said bound form to be released to the liquid composition in said bottle.

Usually, the process will be practiced as part of a continuous filling process in which threaded-necked bottles are automatically advanced to two filling stations, one for introducing liquid product into the bottle and a second for adding the temporarily bound fragrance oils to said bottle. The order in which the liquid product and bound fragrance oils are added to the bottles may vary. In the preferred procedure, product is added at the first fill station and the bound form introduced at the second.

At the liquid product filling stations predetermined quantities of liquid are introduced into the bottle using machinery and techniques well known in this art and not forming part of this invention.

At the fragrance oil filling station the arrangement may vary somewhat depending upon the form of the bound fragrance oil. Where the bound fragrance oils take the form of fragrance oil contained in a capsule, these capsules will usually be loaded into a hopper positioned above the fragrance oil filling station. As the bottle passes into the fragrance oil filling station one or more of the capsules are dropped into the bottle.

When the bound fragrance oil takes the form of gelled fragrance oil it has been found advantageous to adjust the viscosity of the gel so that it is capable of being pumped. This can be accomplished by adding fragrance to the gel composition. This viscosity may vary somewhat but generally it will be in the range of from about 100 to about 10,000 cps, preferably from about 1,000 to about 5,000 cps. The gelled fragrance oil whose viscosity has been adjusted is a highly viscous product and can be stored in a container above the fragrance oil filling station. As the bottle passes under the latter filling station the viscous gelled fragrance oil is pumped into the bottle using arrangements well known to those skilled in the art which do not form part of this invention. The viscous gelled fragrance oil contained therein are not such that the oils contained therein are available to wet the threaded bottle necks.

The threaded bottle containing both liquid product an bound fragrance oil then advances to a capping station were a threaded cap is positioned on the bottle and a torque is applied to the cap to screw it onto the thread of the bottle. The capping arrangement is such that the torque is applied until it has reached a predetermined level which is sensed by a sensing device that signals the termination of the torque applying operation. Capping arrangements of this type are also well known in this art and form no part of the present invention.

The following Examples are given to further illustrate this invention. It is understood, however, that the invention is not limited thereto

EXAMPLE 1

Example 1
Liquid Product With Gelatin Capsuled Fragrance Oil

| Raw Material | Wt. % Nominal Composition |
|---|---|
| Sodium Hypochlorite | 6.00 |
| Sodium Hydroxide | 1.70 |
| Sodium Silicate N (3.22 Ratio $SiO_2/Na_2O$ = 3.22:1) | 0.08 |
| Fragrance Oil* | 0.04 |
| Soft Water | Q.S. to 100 |

*Added as 100% fragrance oil in a gelatin capsule

The composition reported above, absent the fragrance component in bound form, is added to empty bottles (having a threaded neck portion) at a first filling station. After filling to a preset amount, the bottles are conveyed to a second filling station at which capsules containing the fragrance oil are dropped into the bottle through the threaded neck portion, and without contamination of the threads with fragrance oil. Next the bottles are conveyed to a capping station, which screw closures are applied to the neck at a preset torque specification.

The capsule containing the fragrance oil floated on top of the liquid product after they were both contained in the bottle. The capsule dissolved over a period of about one hour releasing the fragrance oil to the liquid product.

EXAMPLE 2

Example 2
Liquid Product With Gelled Fragrance Oil

| Raw Material | Wt. % Nominal Composition |
|---|---|
| Sodium Hypochlorite | 6.00 |
| Sodium Hydroxide | 1.70 |
| Sodium Silicate N (Ratio $SiO_2/Na_2O$ = 3.22:1) | 0.08 |
| Fragrance Gel Mixture | 0.055 |
| Soft Water | Q.S. to 100 |
| Fragrance Gel Mixture | |
| Cab-O-Sil Grade M-5 | 10.0 |
| Sodium Chloride | 17.0 |
| Fragrance Oil | 73.0 |

The procedure is similar to Example 1, except that the fragrance gel mixture is substituted for the capsule. The gel mixture is prepared by mixing the thickening agent with the perfume oil, and then adding the salt to increase gel density.

The fragrance added in the above-identified fashion sinks to the bottom of the liquid product. Within 2-3 hours the gel breaks up releasing the fragrance to the composition.

EXAMPLE 3

The following are further examples of the gel mixture and may be added to a composition following the procedure of Example 1.

| Component | Composition Wt. % | | | |
|---|---|---|---|---|
| | A | B | C | D |
| HiSil T-600 | 10 | | | 8 |
| Cab-O-Sil M5 | | 10 | 7.3 | |
| Sodium Chloride | 15 | 15 | 15.6 | 17 |
| Fragrance oil | 75 | 75 | 77.1 | 75 |

What is claimed is:

1. A process for bottling a liquid product that will contain fragrance oils which comprises
   (a) sequentially filling a bottle having a threaded neck with liquid product and fragrance oils, said fragrance oils being added to said bottle in temporarily bound form whereby the wetting of said bottle neck with fragrance oils is essentially avoided,
   (b) applying a threaded cap to said bottle filled according to step (a) so that the threads on said cap engage the threads on said bottle;
   (c) applying a torque to said cap to tighten it to a predetermined degree on said bottle, and
   (d) subsequent to the filling step (a), allowing said fragrance oil contained in said bottle in said bound form to be released to the liquid product.

2. The process according to claim 1 wherein said fragrance oils in bound form is first added to said bottle followed by the addition of said liquid product.

3. The process according to claim 2 wherein said fragrance oils are added to the bottle as fragrance oils contained in a capsule soluble in said liquid product.

4. The process according to claim 3 wherein said soluble capsule is a gelatin capsule.

5. The process according to claim 4 wherein the liquid product is an aqueous hypochlorite composition.

6. The process according to claim 2 wherein the fragrance oils are added in the form of a fragrance oil gel.

7. The process according to claim 6 said fragrance oil gel has the form of a fragrance oil silica gel.

8. The process according to claim 7 wherein the liquid product is an aqueous hypochlorite composition.

9. The process according to claim 1 wherein the liquid product is first added to said bottle followed by the addition of said fragrance oils in bound form.

10. The process according to claim 9 wherein said fragrance oils are added to said bottle as fragrance oils contained in a capsule soluble in said liquid product.

11. The process according to claim 10 wherein the capsule is a gelatin capsule.

12. The process according to claim 11 wherein said liquid product is an aqueous hypochlorite composition.

13. The process according to claim 9 wherein said fragrance is added to said bottle in the form of a fragrance oil gel.

14. The process according to claim 13 where said fragrance oil gel has the form of a fragrance oil silica gel.

15. The process according to claim 14 wherein said liquid product is an aqueous hypochlorite composition.

16. A process for containing in a package a liquid product that will contain a material capable of adversely affecting closure of the package, the process comprising the steps:
   (a) filling the package having a sealing edge sequentially with liquid product and said material, the material being added to said bottle in temporarily bound form whereby the wetting of said sealing edge with material is essentially avoided,
   (b) closing said package by mating a sealing surface o a closure member with said sealing edge of said package filled according to step (a), and
   (c) subsequent to step (a), allowing said material contained in said package in said bound form to be released to the liquid product.

* * * * *